US005817187A

United States Patent [19]

D'Muhala et al.

[11] Patent Number: 5,817,187

[45] Date of Patent: Oct. 6, 1998

[54] COMPOSITION FOR GREASE REMOVAL

[75] Inventors: Thomas F. D'Muhala, Raleigh; Thomas C. Zietlow, Apex; J. Michael Strickland, Durham, all of N.C.

[73] Assignee: Corpex Technologies, Inc., Morrisville, N.C.

[21] Appl. No.: 644,703

[22] Filed: May 10, 1996

Related U.S. Application Data

[60] Provisional application No. 60/002,119 Aug. 10, 1995.

[51] Int. Cl.[6] ..... B08B 7/00

[52] U.S. Cl. ..... 134/40

[58] Field of Search ..... 134/40

[56] References Cited

U.S. PATENT DOCUMENTS

| | | | |
|---|---|---|---|
| 4,511,488 | 4/1985 | Matta | 252/162 |
| 4,620,937 | 11/1986 | Dellutri | 252/143 |
| 5,084,198 | 1/1992 | Ahmed et al. | 252/99 |
| 5,112,516 | 5/1992 | Koetzle | 252/162 |
| 5,132,039 | 7/1992 | Sugita et al. | 252/162 |
| 5,213,624 | 5/1993 | Williams | 134/40 |
| 5,281,354 | 1/1994 | Faber | 252/154 |
| 5,356,482 | 10/1994 | Mehta et al. | 134/22.1 |

*Primary Examiner*—Kriellion S. Morgan

*Attorney, Agent, or Firm*—Myers Nigel Sibley & Sajovec

[57] ABSTRACT

A composition and method for removing contaminants from metal surfaces is disclosed. The composition comprises 30 to 70 percent by weight of a terpene-based component, 5 to 40 percent by weight of a $C_4$–$C_{10}$ ester of lactic acid or derivative thereof, and 1 to 20 percent by weight of a surfactant.

10 Claims, No Drawings

COMPOSITION FOR GREASE REMOVAL

CROSS-REFERENCE TO RELATED APPLICATIONS

The instant application is related to and claims priority from U.S. Provisional Patent Application Ser. No. 60/002,119, filed 10 Aug. 1995.

FIELD OF THE INVENTION

The present invention relates to a composition and method for removing contaminants. More particularly, the present invention relates to a composition and method for removing grease and other organic contaminants from surfaces.

BACKGROUND OF THE INVENTION

In processing equipment such as pipes, conduits, and vessels, and particularly in oil drill pipe applications, the build-up of grease and other related organic contaminants is often problematic. Specifically, such build-up can lead to reduced heat transfer through the walls of the pipes or vessels, as well as restricting of the passage of fluids through pipes or conduits. The removal of grease is particularly troublesome in oil drill pipe applications wherein metals are contained within the grease.

Typically, grease is removed using a cleaning solvent which is chemically similar to the grease itself. Such solvents have included Naptha; halogenated hydrocarbons such as trichloroethane or mineral spirits; and petroleum fractions. These solvents, however, present heightened environmental risks associated with their use. For example, petroleum fractions and halogenated hydrocarbons are potentially hazardous due to their volatility. Moreover, their use is tightly controlled by the Occupational Safety and Health Administration because of their alleged carcinogenic nature.

As an alternative to employing solvents, it has been proposed to encapsulate organic contaminants in a solid material. For example, U.S. Pat. No. 4,274,880 to Chappell proposes a method of treating oily substances by mixing such with solids such as fly ash and cement particles. Such methods, however, suffer from various drawbacks. This technique allows only relatively limited quantities of organic contaminant to be removed at one time as large quantities of fly ash are often necessary to absorb smaller quantities of the oil. Additionally, such techniques usually involve handling and storing fly ash which contains the oil, which is often expensive and time-consuming.

It would be desirable to provide a composition and method for decontaminating a surface which utilizes substantially non-hazardous chemicals such that the composition is biodegradable. Moreover, it would be particularly desirable to provide a composition and method for decontaminating a surface such that subsequent to decontamination the composition is readily re-usable.

SUMMARY OF THE INVENTION

In view of the foregoing, it is an object of the present invention to provide a composition and method for removing greases and other organic contaminants in which the composition contains substantially non-hazardous chemicals.

It is another object of the present invention to provide a composition and method for removing greases and other organic contaminants in which the composition is biodegradable and allows the contaminants to be separated from the composition such that the composition is re-usable.

These and other objects, features, and advantages are provided by the present invention.

The present invention provides a composition for removing contaminants from a surface. For the purposes of the invention, the composition is employed to remove organic contaminants such as grease and the like. Specifically, the composition comprises 30 to 70 percent by weight of a terpene-based component, 5 to 40 percent by weight of a $C_4$–$C_{10}$ ester of lactic acid or derivative thereof, and 1 to 20 percent by weight of a surfactant.

The present invention also provides a method of decontaminating a surface. The method comprises providing a surface having the organic contaminant, along with applying a composition to the surface so as to remove the organic contaminant from the surface. The composition comprises 30 to 70 percent by weight of a terpene-based component, 5 to 40 percent by weight of a $C_4$–$C_{10}$ ester of lactic acid or derivative thereof, and 1 to 20 percent by weight of a surfactant. In one embodiment, the method may include separating the composition from the contaminant such that the composition is re-usable.

DETAILED DESCRIPTION OF THE PREFERRED EMBODIMENTS

The present invention will now be described more fully hereinafter. This invention may, however, be embodied in many different forms and should not be construed as limited to the embodiment set forth herein; rather, this embodiment is provided so that this disclosure will be thorough and complete, and will fully convey the scope of the invention to those skilled in the art.

As summarized above, the composition of the present invention rapidly removes organic contaminants from a surface. Such organic contaminants which may be removed are numerous including, for example, oils, greases, waxes, paraffins, tars, asphaltenes, and the like, with heavy grease being one which is typically removed. The contaminants may be removed from any surface upon which the above contaminants accumulate. Typically, for example, the organic contaminants are contained on a metal surface such as that found in an oil drill pipe application. Specifically, the composition includes a terpene-based component, a $C_4$–$C_{10}$ ester of lactic acid or derivative thereof, and a surfactant. Water can also be included to dilute the composition.

Suitable terpene-based components have the general chemical formula of $C_{10}H_{16}$ and are based on the isoprene unit $C_5H_8$. Preferred terpene compositions of the present invention include d-limonene, alpha-terpineol, beta-terpineol, alpha-pinene, beta-pinene, 1-methyl-4-isopropylene-1-cyclohexane, and alcohols of such compositions. Additionally, terpenes with a flash point greater than 140° F. may be employed. Particularly preferred terpenes are SCM/Glidco Organics of Jacksonville, Fla., Glidsol-180®, Reentry Solvent D® sold by Environmental Solvents of Jacksonville, Fla., Petroferm® D-312 sold by Petroferm Inc. of Fernandina Beach, Fla., and Petroferm® Bioact sold by Petroferm Inc. of Fernandina Beach, Fla.

Preferably, the terpene-based component is employed in an amount ranging from 30 to 80 percent by weight of the composition, more preferably, from 50 to 75 percent by weight and most preferably, from 60 to 70 percent by weight.

Numerous $C_4$–$C_{10}$ esters of lactic acid or derivative thereof may be employed in the composition. Preferred compounds are selected from the group consisting of ethylhexyl lactate, octyl lactate, and the like, and mixtures thereof.

Preferably, the $C_4$–$C_{10}$ ester of lactic acid is employed in an amount ranging from 5 to 40 percent by weight of the composition, more preferably, from 15 to 30 percent by weight and most preferably, from 20 to 25 percent by weight.

Any suitable surfactant or mixtures of surfactant can be used and can be of the non-ionic, anionic, cationic or amphoteric type, and of natural or synthetic origin. Suitable surfactants for use in the present invention include, but are not limited to, nonylphenol alkanolamide, (nonylphenoxy) polyethylene oxide, sodium salts of petroleum sulfonic acid, sorbitan sesquioleate, nonylphenol ethoxylate (3–12 moles of ethylene oxide), alcohol ethoxysulfate, polyoxyethylene-polyoxypropylene block copolymer, octylphenoxypolyethoxyethyanol (3–12 moles ethylene oxide), octylphenol ethoxylate (3–12 moles ethylene oxide), and mixtures thereof. Preferred surfactants are non-ionic surfactants such as Mazclean EP™ sold by PPG Industries of Gurnee, Ill.; T-Det N9.5™ sold by Harcros Chemicals of Kansas City, Kans.; Steol L-101™ sold by Stepan Co. of Northfield, Ill.; Pluronic L-101™ sold by BASF of Wyandotte, Mich.; and Triton X-100™ and Triton X-114™, both of which are sold by Union Carbide of Danbury, Conn.

Preferably, the surfactant is employed in an amount ranging from 1 to 20 percent by weight of the composition, and more preferably, from 10 to 15 percent by weight and most preferably, from 10 to 13 percent by weight.

An inorganic scale removing compound may be employed for removing inorganic scale from a surface. For the purposes of the invention, the term "inorganic scale" may be construed to include, but is not limited to, oxides, sulfates, and phosphates of metals such as iron, calcium, and barium. Any appropriate inorganic scale removing compound may be used including, but not limited to, polycarboxylic acids, aminopolycarboxylic acids, along with salts and mixtures thereof. Aqueous blends of any of the above components may be employed. Suitable polycarboxylic acids include citric acid, oxalic acid, and mixtures thereof. Suitable polyaminocarboxylic acids include ethylenediaminetetraacetic acid, diethylenetriaminepentaacetic acid, triethylenetetraaminehexaacetic acid, N-2-hydroxyethylethylenediaminetriacetic acid, propylene-1,2-diaminetetraacetic acid, propylene-1,2-diaminetetraacetic acid, nitrilotriacetic acid, the ammonium and alkali metal salts of the acids, and mixtures thereof.

A hydrazide may be employed as the inorganic scale removing compound, alone or in mixture with any of the other above compounds. For the purposes of the invention, a hydrazide includes a suitable hydrazide compound, an alkali metal or ammonium salt of the hydrazide, or mixtures thereof. Hydrazides which may be employed are numerous and include those described, for example, in U.S. Pat. Nos. 4,609,757 and 4,726,907 to D'Muhala et al.; and U.S. Pat. No. 4,708,805 to D'Muhala, the disclosures of which are incorporated by reference in their entirety. Typically, the hydrazides are derived from known reactions which typically involve amino polycarboxylic acids such as, for example, an amino polyacetic acid. Specifically, tetrahydrazide formed from EDTA may be employed. Other hydrazides which may be used include carboxyhydrazides, i.e. polycarbazic acids. Exemplary polycarbazic acids are of the general formula:

$$(R)_2—N—[CH_2CH_2N(R)]_m—R$$

wherein R is the group $CH_2$—CO—NH—NH—COOH and m is 0 or an integer from 1 to 4. Preferably, m is 0 or 1.

Another suitable polycarbazic acid includes that described by the general formula:

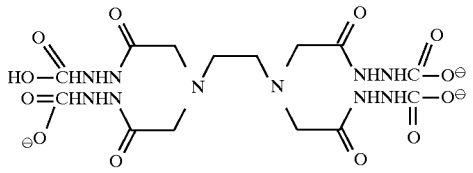

The inorganic scale removing compound may be employed in any appropriate amount. Preferably, the composition includes from 0.1 to 50 weight percent of the inorganic scale removing compound, and more preferably from 3 to 10 weight percent.

Various dispersants may be used in the invention. A suitable dispersant for organic contaminants is Tamol SN™, a sodium salt of naphthalenesulfonic acid, available from Rohm & Haas, Philadelphia, Pa. A suitable dispersant for inorganic scale is sodium lignosulfonate. Preferably, the composition may comprise between 0 to 1 weight percent of dispersant.

Various foamers may be used in conjunction with the inorganic scale removing compound. The foamers are designed to increase the contact time on the surface, especially a vertical surface. Preferably, polyethylene glycol is employed as the foamer. A commercially preferred foamer composition includes 33 weight percent of Polyglycol P 425™ sold by Dow Chemical Company of Midland, Mich. and 67 weight percent of Tegobetaine S™ sold by Goldschmidt Chemical Corp. Preferably, the composition comprises between 0 to 1 weight percent of foamer.

A gelling agent may be employed with the inorganic scale removing compound. The gelling agent is designed to increase the contact time with the surface, especially a vertical surface. Preferably, hydroxypropyl methylcellulose is utilized. A commercially preferred gelling agent is Methocel 311™ sold by Dow Chemical Corp. of Midland, Mich. The composition preferably comprises between 0 to 1 weight percent of gelling agent.

The present invention is also directed to a method for removing an organic contaminant from a surface. The method includes providing a surface having an organic contaminant, applying a composition to the surface so as to remove the organic contaminant from the surface. In one embodiment, the method includes separating the composition from the contaminant such that the composition may be re-used. Preferably, the separation is carried out by heating the composition.

The composition is typically applied to the surface having the organic contaminant using a hand held spray gun adapted to administer the composition. Suitable means for applying the composition are disclosed in U.S. Pat. Nos. 3,436,783 to McCartney; 4,157,096 to Miller, Jr.; and 4,372,003 to Toelke, the disclosures of which are incorporated herein by reference. In operation, the composition is heated preferably to a temperature of up to 140° C. Application can occur by spraying, immersing, showering, etc. An optional water rinse can be used after application.

The invention is effective at ambient temperatures and pressures and dilutable with water where it can form a stable emulsion. The chemistry is biodegradable and does not contain halogenated hydrocarbons. After use, the aqueous emulsion containing the removed contaminant can be heated to greater than about 122° F., upon which the mixture rapidly separates into three layers: a clear water layer; a clear layer containing the composition of the invention, and a layer of contaminant. These layers can be separated for re-use of the invention and water and disposal of the waste contaminant. Advantageously, the composition can be easily re-employed and the contaminant can be readily disposed of without any further separation processes.

The method of the invention also may include applying an inorganic scale removing compound to the surface so as to remove inorganic scale that may be present on the surface. The inorganic scale removing compound may be applied by any suitable means known to the skilled artisan. For example, such compounds could be applied to the surface in a dip tank with or without agitation; sprayed onto the surface at low to high pressures such as 30 to 250 psi; foamed onto a surface using a foaming additive; and gelled onto the surface using an appropriate gelling agent.

The foregoing examples are illustrative of the present invention, and are not to be construed as limiting thereof.

EXAMPLE 1

5 grams of each grease was added to 250 mL beakers. To each beaker was added 25 mL of the degreaser to be tested. The invention example consisted of 67% (by volume) terpene hydrocarbons (for example, SCM/Glidco Organics Glidsol-180), 22% octyl lactate and 11% PPG Mazclean EP non-ionic surfactant blend. Each was stirred for 10 minutes or until grease was dissolved.

| Solvent | Results |
|---|---|
| a. Wire Line Dressing | |
| Trichloroethane | 98% dissolved after 10 minutes |
| JET LUBE 5000 ™ | Flocculate, no dissolution |
| Invention | 98% dissolved after 10 minutes |
| b. Lithium Grease | |
| Trichloroethane | 100% dissolved after 10 minutes |
| JET LUBE 5000 ™ | 90% dissolved after 10 minutes |
| Invention | 95% dissolved after 10 minutes |
| c. Aluminum Complex Grease | |
| Trichloroethane | 100% dissolved after 6–7 minutes |
| JET LUBE 5000 ™ | Flocculate, no dissolution |
| Invention | 100% dissolved after 8 minutes |

EXAMPLE 2

5.2 g of KOPR-KOTE™ copper-based grease on a carbon steel (1010) coupon was immersed in a 50:50 emulsion of the invention and water (80 mL). After 60 minutes at 70° F., all of the copper-based grease was removed from the coupon. The emulsion mixture of invention, water and contaminant was heated to greater than 122° F., at which point the mixture separated into 3 distinct phases: a clear invention solution, a thin contaminant layer and a clear water layer. The three distinct layers were stable upon cooling to room temperature. The invention layer (25 mL) and water (25 mL) were separated from the contaminant layer and remixed, forming a stable emulsion at 70° F. which was used to clean KOPR-KOTE™ copper-based grease (3.0 g) off of another coupon.

EXAMPLE 3

100 ml each of Invention A (66.7 volume percent Glidsol-180™, 22.2 volume percent octyl lactate, and 11.1 volume percent of Mazclean EP™); Invention B (66.7 volume percent Soy Gold™, 22.2 volume percent octyl lactate, and 11.1 volume percent of Mazclean EP™); Invention C (66.7 volume percent Glidsol-180™, 22.2 volume percent ethylhexyl lactate, and 11.1 volume percent of Mazclean EP™); and Invention D (66.7 volume percent Soy Gold™, 22.2 volume percent ethyl hexyl lactate, and 11.1 volume percent of Mazclean EP™) were each mixed in 250 ml beakers deionized water to form solutions having compositions of 10 and 50 weight percent. The solutions were heated on a hot plate to 80° C. and the stirring rate of the solutions was set at 400 rpm utilizing 1 inch stir bars. Eight 2×3.5 inch aluminum coupons were coated with a 1×1.25 inch coating of KOPR-KOTE™. Each of the eight coated coupons were placed in the prepared solutions. The time required to remove 95 percent of the KOPR-KOTE™ was recorded for the solutions as described in the table below.

| Invention | % Solution | Removal Time (min:sec) | Separation % (Bottom/Top) | Phase Transition |
|---|---|---|---|---|
| A | 10% | 1:15 | 98/2 | Gradual |
| A | 50% | 0:15 | 98/2 | Gradual |
| B | 10% | 1:50 | 98/2 | Gradual |
| B | 50% | 18:30 | 50/50 | Sharp |
| C | 10% | 1:00 | 98/2 | Gradual |
| C | 50% | 0:15 | 50/50 | Gradual |
| D | 10% | 2:20 | 98/2 | Gradual |
| D | 50% | 2:20 | 50/50 | Gradual |

As shown, the Glidsol-180™ formulations of the invention (i.e., Invention A and Invention C) exhibits faster removal rates than the Soy Gold® formulations (i.e., Invention B and Invention D), with the 50 percent concentrations being particularly effective.

It was concluded that there appears to be no indicator color or combination of colors (e.g., white on the bottom and amber on top) that corresponds to effectiveness. The physical parameter that correlates with removal rate is the transition at the interface of the two phases, being either gradual or sharp. At 80° C. and heavy agitation, a gradual transition is faster than a sharp transition by an order of magnitude.

EXAMPLES 4–5

Examples 4 and 5 further illustrate the removal of wax from metal. Specifically, two metal strips were dipped in melted Platers Wax and allowed to cool. The metal strips were each about 8 inches long with the wax covering about 6 inches of the strip.

EXAMPLE 4

The bottom 2 inches of one of the metal strips was placed into a beaker with 55 ml of Invention A at 80° C. (without stirring). After 15 minutes, the piece was removed, rinsed with tap water, dried, and examined. The wax had been removed leaving no apparent residue.

EXAMPLE 5

The bottom of the second strip described above was placed into a aqueous solution (50%) of Invention A at 70° C. An identical strip was placed in water heated to 70° C. After 1 hour, it was found that most of the wax had been dissolved from the strip with only a thin film remaining. At 1 hour and 45 minutes, the strip was removed and rinsed in hot tap water. After drying, there was no wax or residue remaining. The wax in the water only was removed from the bath, rinsed in hot tap water, and weighed. There was no weight loss.

With respect to Examples 4 and 5, the longer cleaning time is associated with a slightly lower temperature and no solvent flow around the strip.

EXAMPLE 6

Two strips of metal were dipped into Platers Wax and were allowed to cool. The strips of metal were about eight inches long with wax covering about six inches of the strips. The wax was brown in color, slightly soft, with a mild crayon-like odor. One strip was placed into a beaker containing Invention A solution encompassing the composition of the invention, the other strip in water. Both samples were kept at 70° C. for a half an hour.

Then each strip was removed from their respective solutions, rinsed under hot tap water, dried, and weighed. It was determined that the wax had been removed by the Invention A solution and there was no apparent residue. The water had no effect.

| Sample | Solution | Weight Loss |
|---|---|---|
| A | Invention A | 0.165 g |
| B | DI water | 0.009 g |

The invention has been described in detail with reference to its preferred embodiments and its examples. However, it will be apparent that numerous variations and modifications can be made without departure from the spirit and scope of the invention as described in the foregoing detailed specification and claims.

That which is claimed:

1. A method of decontaminating a surface comprising:

providing a surface having an organic contaminant; and applying a composition to the surface, the composition comprising 30 to 70 percent by weight of a terpene-based component, 5 to 40 percent by weight of a $C_4$–$C_{10}$ ester of lactic acid or derivative thereof, and 1 to 20 percent by weight of a surfactant so as to remove the organic contaminant from the surface.

2. The method according to claim 1 wherein the terpene-based component is selected from the group consisting of d-limonene, alpha-terpineol, beta-terpineol, alpha-pinene, beta-pinene, 1-methyl-4-isopropylene-1-cyclohexane, and mixtures thereof.

3. The method according to claim 1 wherein the $C_4$–$C_{10}$ ester of lactic acid or derivative thereof is selected from the group consisting of ethylhexyl lactate, octyl lactate, and mixtures thereof.

4. The method according to claim 1 wherein the $C_4$–$C_{10}$ ester of lactic acid or derivative thereof is octyl lactate.

5. The method according to claim 1 wherein the surfactant is selected from the group consisting of nonylphenol alkanolamide, (nonylphenoxy)polyethylene oxide, sodium salts of petroleum sulfonic acid, sorbitan sesquioleate, nonylphenol ethoxylate, alcohol ethoxysulfate, polyoxyethylene-polyoxypropylene block copolymer, octylphenoxypolyethoxyethanol, octylphenol ethoxylate, and mixtures thereof.

6. The method according to claim 1 wherein the composition further comprises water.

7. The method according to claim 1 wherein the surface contains inorganic scale and further comprising applying an inorganic scale removing compound to the surface so as to remove the inorganic scale from the surface.

8. The method according to claim 7 wherein the inorganic scale removing compound is selected from the group consisting of ethylenediaminetetraacetic acid, citric acid, oxalic acid, a hydrazide, and mixtures thereof.

9. The method according to claim 1 further comprising separating the composition from the contaminant such that the composition may be re-used.

10. The method according to claim 9 wherein said step of separating the contaminant from the composition is carried out by heating the composition.

* * * * *